US005614787A

United States Patent [19]

Kawai et al.

[11] Patent Number: 5,614,787

[45] Date of Patent: Mar. 25, 1997

[54] METAL HALIDE LAMP HAVING HEAT DAM PORTION

[75] Inventors: Kouji Kawai; Shigeki Ishihara; Naoki Masuda; Hirohisa Ota; Osamu Yogi, all of Hamamatsu, Japan

[73] Assignee: Hamamatsu Photonics K.K., Hamamatsu, Japan

[21] Appl. No.: 496,907

[22] Filed: Jun. 29, 1995

Related U.S. Application Data

[63] Continuation of Ser. No. 325,910, Oct. 19, 1994.

[30] Foreign Application Priority Data

Oct. 19, 1993 [JP] Japan ..... 5-260941

[51] Int. Cl.[6] ..... H01J 17/18

[52] U.S. Cl. ..... 313/623; 313/624; 313/625

[58] Field of Search ..... 313/623, 624, 313/625, 631, 267, 41, 43

[56] References Cited

U.S. PATENT DOCUMENTS 3,248,586 4/1966 Schlegel .
5,461,281 10/1995 Fromm et al. ..... 313/639

FOREIGN PATENT DOCUMENTS 0416937 3/1991 European Pat. Off. .
4280057 10/1992 Japan .
582086 4/1993 Japan .
545389 5/1942 United Kingdom .
2107921 5/1983 United Kingdom .
2199693 7/1988 United Kingdom .

*Primary Examiner*—Sandra L. O'Shea
*Assistant Examiner*—Vip Patel
*Attorney, Agent, or Firm*—Cushman Darby & Cushman, IP Group of Pillsbury Madison & Sutro, LLP

[57] ABSTRACT

A metal halide lamp comprises a sealed tube containing mercury vapor and halide, and electrodes extending to a center of the sealed tube, supported by sealed portions at both ends of the sealed tube. A notch extending in a direction perpendicular to an axis of the electrode is formed in each electrode. A transverse cross sectional area of a portion where the notch is formed is smaller than the transverse cross sectional area of another portions and functions as a heat dam portion for damming heat. Accordingly, temperature of a proximal portion from the heat dam portion to the support portion is lower than that of the same portion of the conventional electrode, and temperature of a distal end portion is higher than that of the same portion of the conventional electrode. Thus, formation of low-melting alloy due to reaction of the proximal portion of the electrode and the metal halide can be suppressed.

31 Claims, 17 Drawing Sheets

ELECTRICAL RATING (B)

METAL HALIDE LAMP HAVING HEAT DAM PORTION

This is a continuation of application Ser. No. 08/325,910, filed Oct. 19, 1994 pending.

BACKGROUND OF THE INVENTION

1. Field of the Invention

The present invention relates to a metal halide lamp, and more particularly to an electrode utilized in a metal halide lamp.

2. Related Background Art

A metal halide lamp is an electric discharge lamp in which metal halides are added to the contents of a sealed tube or a bulb, and a lamp which is capable of improving luminous efficiency and color rendering properties utilizing a spectral line of each added metal atoms or emission of molecular spectrum of each metal halide and, if desired, capable of obtaining emission in a certain wavelength region. These metal halide lamps are utilized as wide illumination for roads, sports fields etc., room lighting for stores, a light source for an overhead projector, a liquid crystal projector, a slide projector etc.

Conventionally, a cylindrical tungsten electrode having the same diameter along its entire length, a tungsten electrode in which a diameter of a proximal portion (portion near a sealed portion of a bulb) is large, which is disclosed in Japanese Patent Laid-Open No. HEI 5-82086 (82086/1993), and a tapered tungsten electrode in which a diameter gradually becomes small from a distal end or an inner end to a proximal portion, which is disclosed in Japanese Patent Laid-Open No. HEI 4-280057 (280057/1992) are known as tungsten electrodes used in general metal halide lamps.

In these conventional metal halide lamps, a part of an electrode near a sealed portion of a bulb reacts with a metal halide and generates a low-melting alloy. This low-melting alloy tends to deposit on a spherical portion or luminous portion of the bulb to whiten the luminous portion. Further, the deposited low-melting alloy may react with silica glass of which the bulb is made, thereby to occur crystallization, which may cause decrease of pressure resistance of a bulb and damage of a bulb.

SUMMARY OF THE INVENTION

It is an object of the present invention to provide a metal halide lamp which is capable of suppressing formation of low-melting alloy inside a bulb or capable of suppressing deposit of formed low-melting alloy to an inner wall surface of a bulb.

To attain the above-mentioned object, a metal halide lamp of the present invention comprises: a sealed tube capable of transmitting light therethrough, containing metal vapor and halide therein; and a pair of electrodes supported by support portions of the sealed tube, each of said electrodes having an distal end which extends to the inside of the sealed tube and the electrodes being arranged so that the distal ends are opposed and spaced to each other by a certain distance, and the metal halide lamp is characterized in that at least one of the electrodes has a heat dam portion provided between the distal end and a portion supported by the support portion of the sealed tube, and that the heat dam portion has a smaller transverse cross sectional area than a portion adjacent to the heat dam portion on the side of the distal end and a portion adjacent to the heat dam portion on the side of the support portion.

In the above-described configuration, a portion of the electrode having a smaller cross-sectional area functions as a heat dam portion for damming heat. Accordingly, temperature of a proximal portion from the heat dam portion towards the support portion is lower than that of the same portion of the conventional electrode, and temperature of a distal end is higher than that of the same portion of the conventional electrode. Consequently, formation of low-melting alloy due to reaction of proximal portion of electrode and metal halide can be suppressed. Further, formed low-melting alloy is trapped by the distal end of the electrode with a higher temperature, so that an amount of low-melting alloy repelled to the inner wall surface of the sealed tube due to arc discharge is decreased.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

Figure 1:
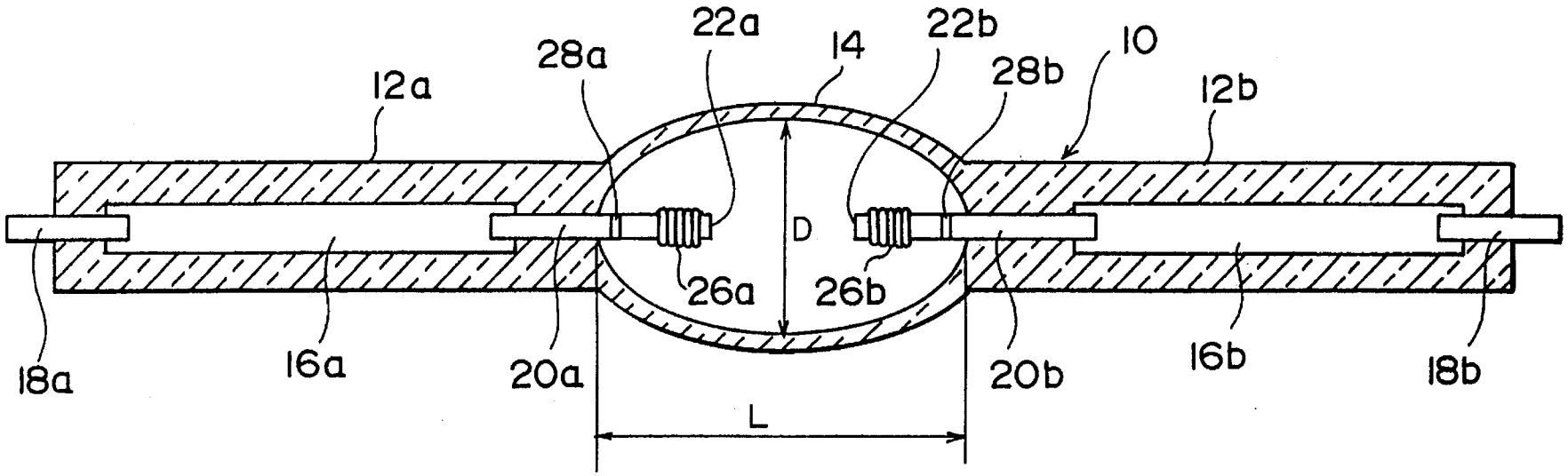
FIG. 1 is a sectional view showing a metal halide lamp according to the first embodiment of the present invention.

Referring now to the drawings, and particularly, to FIG. 1, there is shown a sectional view of the first embodiment of a metal halide lamp according to the present invention. In the following description, like references characters designate like or corresponding parts throughout the several views. Also, alphabets (a's or b's) written to the right of reference numerals in the following description and drawings are written for clarity and for convenience' sake.

The metal halide lamp in FIG. 1 has a transparent sealed tube or bulb 10 made of silica glass, and both ends of the bulb 10 are sealed by melting and solidifying the ends. These sealed end portions 12*a* and 12*b* are substantially cylindrical and coaxially arranged to each other. A portion between the sealed portions 12*a* and 12*b* is substantially ellipsoidal or substantially spherical and this portion functions as a luminous portion 14. The size of the luminous portion 14 is different depending on input power but for example, for a 575 W-alternative current metal halide lamp, a largest diameter D of the luminous portion 14 is approximately 21 mm and a length L along its axis is approximately 25 mm.

Elongate molybdenum foils 16*a* and 16*b* as electrical conductive members are embedded in the respective sealed portion 12*a* and 12*b* of the bulb 10. One ends of the molybdenum foils 16*a* and 16*b* are electrically connected with external lead pins 18*a* and 18*b* through platinum, respectively. One ends of the external lead pins 18*a* and 18*b* are fixed by the sealed portions 12*a* and 12*b* and the other ends extend to the outside of the bulb 10 along the axis of the bulb 10. The other ends of the molybdenum foils 16*a* and 16*b* are electrically connected with electrodes 20*a* and 20*b* through platinum. The electrodes 20*a* and 20*b* are made of tungsten as a base material. One ends of the electrodes 20*a* and 20*b* are supported and fixed by the sealed portions 12*a* and 12*b* and the other ends (hereinafter called inner ends) 22*a* and 22*b* extend towards the center of the luminous portion 14 along the axis of the bulb 10. The inner end 22*a* or 22*b* of the electrode 20*a* or 20*b* is opposed to and apart from the inner end 22*b* or 22*a* of the other electrode 20*b* or 20*a* by a certain distance.

The luminous portion 14 of the bulb 10 is hollow. Although various kinds of materials can be contained in the luminous portion 14, in this embodiment, argon (Ar), rare earth metal (Ln), mercury (Hg), cesium (Cs), iodine (I), and bromine (Br) are contained. In the manufacture of the lamp, these contents are charged in the bulb 10 in the form of atoms or compounds. More specifically, bromides of rare earth metal ($LnBr_2$ and $LnBr_3$), mercury iodide ($HgI_2$), cesium iodide (CsI), argon gas and mercury are charged in the bulb 10 in the manufacture of the lamp.

The metal halide lamp having the above configuration is powered from external exposed portions of the external lead pins 18*a* and 18*b* by a power supply not shown. Electricity applied to the external lead pins 18*a* and 18*b* is transmitted to the electrodes 20*a* and 20*b* through the molybdenum foils 16*a* and 16*b*, respectively, and then discharge is started between the electrode 20*a* and the electrode 20*b* and light emission is generated in the luminous portion 14.

Next, the electrodes 20*a* and 20*b* used in the metal halide lamp according to the first embodiment of the present invention will be described in detail.

Figure 2:
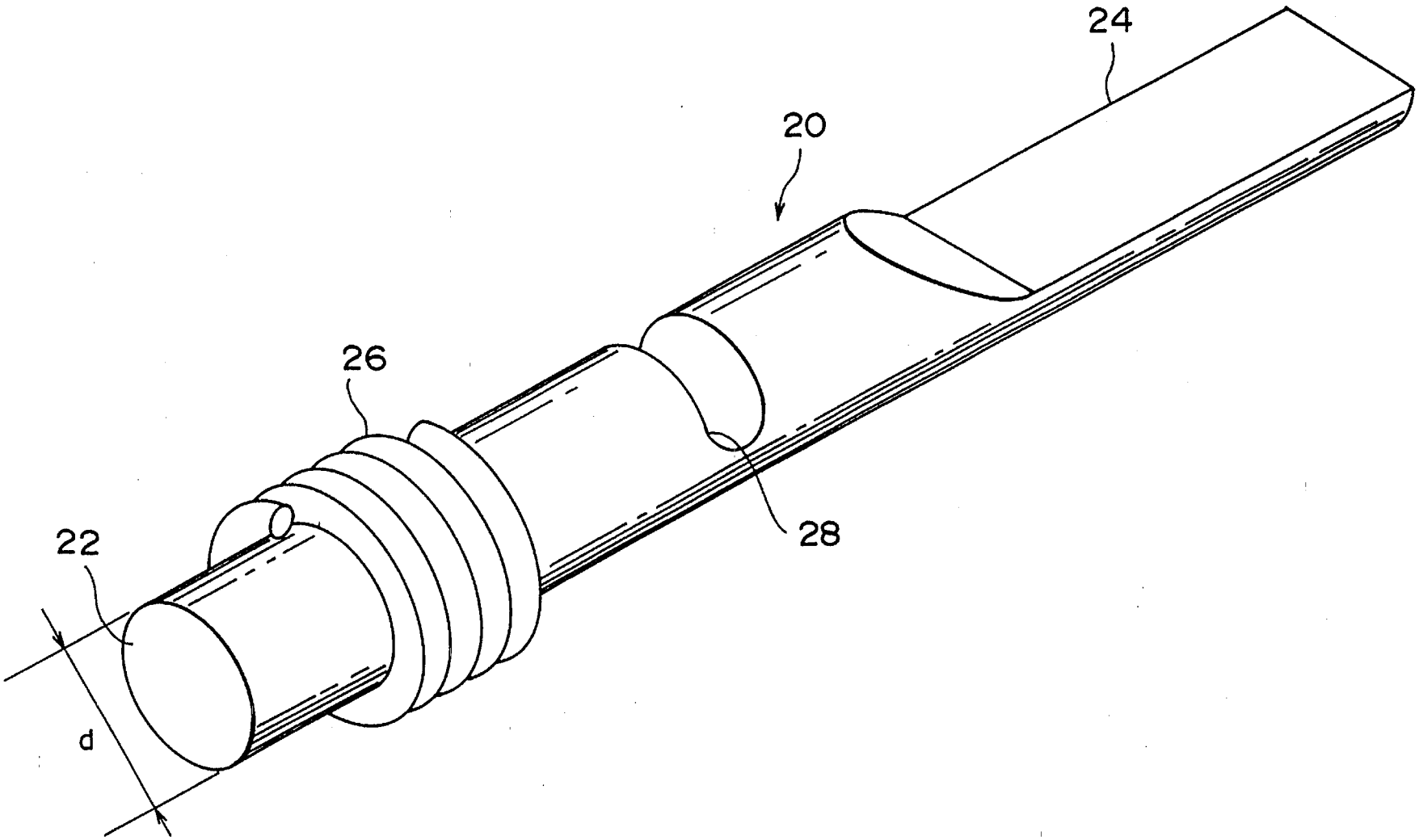
FIG. 2 is a perspective view showing an electrode used in a metal halide lamp according to the first embodiment of the present invention.

Referring to FIG. 2 as well as FIG. 1, the electrode 20 is made of a cylindrical tungsten rod and an upper portion of one end portion 24 of the tungsten rod is cut off so that the cross section thereof is semicircular, and then the upper surface is made flat. The end portion 24 is embedded in the sealed portion 12*a* or 12*b* of the bulb 10 and supported therein. It is preferable that tungsten coil 26 is wound onto the other end of the tungsten rod, i.e., a portion spaced apart from the inner end 22 by a certain distance. The tungsten coil 26 has a heat storage function which is to make temperature around the inner end 22 higher.

Further, a groove or notch having a U-shaped cross section is formed in a portion of the electrode 20 between the tungsten coil 26 and the end portion 24 having a semicircular cross section. The notch 28 extends in a direction perpendicular to the axis of the electrode 20. With the formation of notch 28, the cross sectional area of the portion where the notch 28 is formed is smaller than the cross sectional areas of portions in front and in the rear of the notch 28. It is to be noted that the cross sectional areas of the portions in front and in the rear of the notch 28 are substantially equal but depending on processing accuracy, their cross sectional areas or their diameters may differ a little. It is preferable that when the electrode 20 is fixed on a predetermined position of the bulb 10, the notch 28 is arranged on a position near the sealed portion 12*a* or 12*b* in the luminous portion 14 of the bulb 10, e.g., on a position spaced apart from the sealed portion by 1 mm–4 mm.

In the electrode 20 having a substantially circular cross section, it is known from various experiments that a relation between the diameter d of the inner end face of the electrode 20 and current I flowing into the electrode 20 desirably satisfies $$0.05\times I<d^2<0.47\times I.$$

If the relation is within this range, arc swinging and arc dissipation generation can be suppressed.

In the present embodiment, pure tungsten is used as a material composing a tungsten rod but the material is not limited to this. For example, the material can be tungsten doped with thorium.

Figure 3:
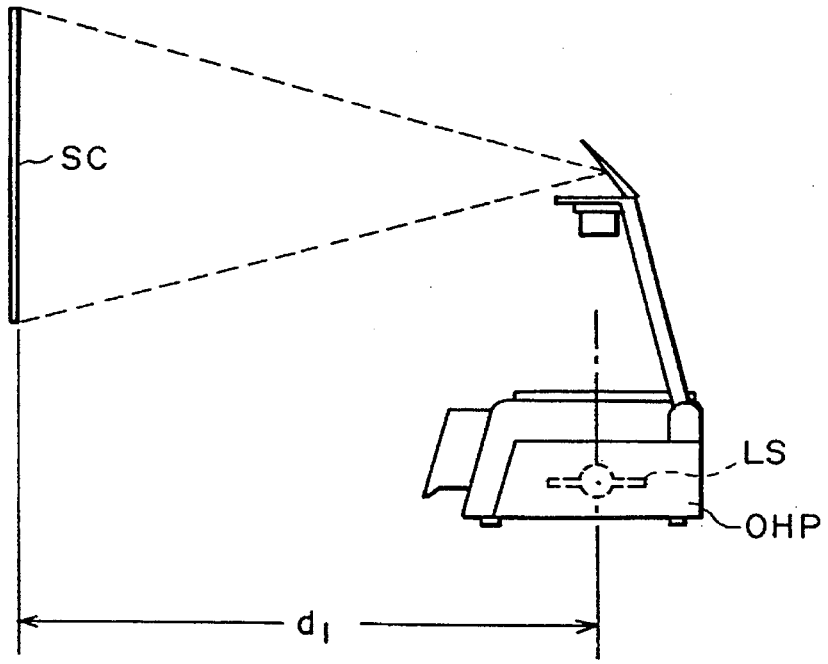
FIG. 3 is a view illustrating equipments for experimentation to compare a metal halide lamp of the present invention and a conventional metal halide lamp.
Figure 4:
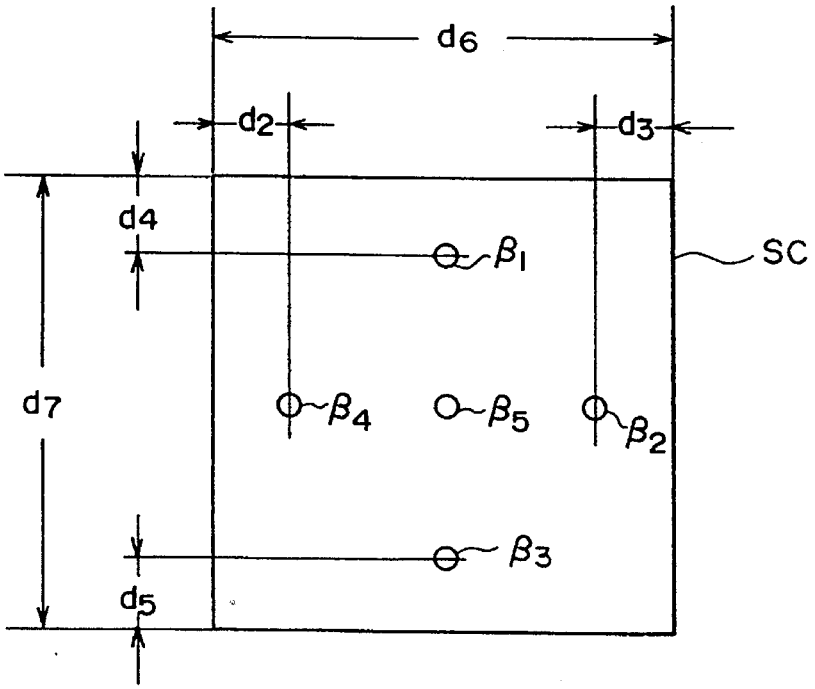
FIG. 4 is a front elevational view of a screen shown in FIG. 3.

The inventors experimented to compare metal halide lamps according to the first embodiment of the present invention and a conventional metal halide lamp. In this experiment, various kinds of metal halide lamps were placed as light sources LS in an overhead projector OHP as shown in FIG. 3, and illuminance at five measurement points $\beta_1$–$\beta_5$ on a screen SC as shown in FIG. 4 was averaged, which was an average illuminance of the measured metal halide lamp. In FIG. 3 and FIG. 4, $d_1$ was 1390 mm; $d_2$–$d_5$, 150 mm; and $d_6$ and $d_7$, 1170 mm.

Figure 5:
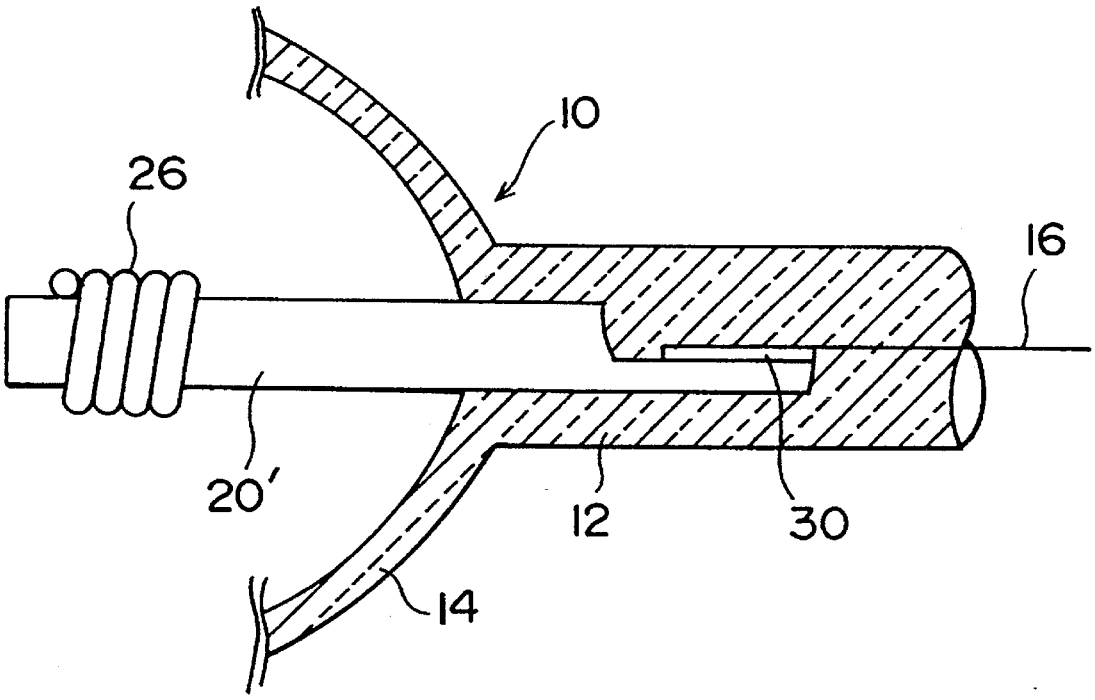
FIG. 5 is a partial sectional view showing a conventional metal halide lamp.

In this experiment, for both the metal halide lamp of the present invention and the conventional metal halide lamp, a bulb the luminous portion of which has a 25 mm length in the axis direction, a 3.2 cc volume and a largest diameter D of 21 mm was used. Further, for the electrode of the metal halide lamp of the present invention, an electrode having a 17 mm length, a 1.25 mm diameter d in the cylindrical portion, a 3 mm length in the end portion 24 having a semicircular cross section and a notch 28 having approximately 0.625 mm depth of cut. Furthermore, a distance between the inner ends of the electrodes was 7 mm. Accordingly, the notch 28 was placed on the position spaced apart from the inner surface of the sealed portion 12*a* or 12*b* by about 3 mm. A tungsten coil 28 made of wire having a diameter of 0.7 mm was wound on to the electrode 20 about 3.5 mm from a position separated apart from the inner end 22 by about 1 mm. On the other hand, as shown in FIG. 5, for an electrode 20' to be used in the conventional metal halide lamp, an electrode which was as same as the electrode 20 of the present invention except that a notch was not formed therein. Further, the location of the electrode 20' was substantially the same as that of the metal halide lamp of the present invention. Note that in FIG. 5, reference numeral 30 is a platinum for connecting a molybdenum foil 16 and the electrode 20'.

The following Table shows composition of the contents (excluding argon) of three kinds of metal halide lamps used in this experiment. These metal halide lamps are represented by A, B and C hereinafter.

TABLE 1

| | Added Material | | | | | | | | | |
|---|---|---|---|---|---|---|---|---|---|---|
| | Rare Earth Metal | | | | Alkali Metal | Halogen | | | | |
| | Er × $10^{-6}$ mol | Dy × $10^{-6}$ mol | Ho × $10^{-6}$ mol | Tm × $10^{-6}$ mol | Cs × $10^{-6}$ mol | I × $10^{-6}$ mol | Br × $10^{-6}$ mol | $HgI_2$ | Hg mg | Electrode |
| A | 10.38 | 10.38 | 10.38 | 10.38 | 4.269 | 5.064 | 30.3 | 1.4 mg 6.16 × $10^{-6}$ mol | 50 | Electrode of First Embodiment |
| B | 10.38 | 10.38 | 10.38 | 10.38 | 5.064 | 5.064 | 30.3 | 2.0 mg 8.8 × $10^{-6}$ mol | 50 | Electrode of First Embodiment |
| C | 10.38 | 10.38 | 10.38 | 10.38 | 5.064 | 5.064 | 30.3 | 20 mg 8.8 × $10^{-6}$ mol | 50 | Conventional Electrode |

Points of difference among the metal halide lamps A, B and C are shown in the above table, but briefly explaining, difference between the metal halide lamp A and the metal halide lamps B and C is a contained amount of $HgI_2$, and difference between the metal halide lamps A and B and the metal halide lamp C is that an electrode is whether an electrode of the present invention or a conventional electrode. It is to be noted that generally a metal halide lamp in which a contained amount of $HgI_2$ is large tends to have a longer life time.

Figure 6:
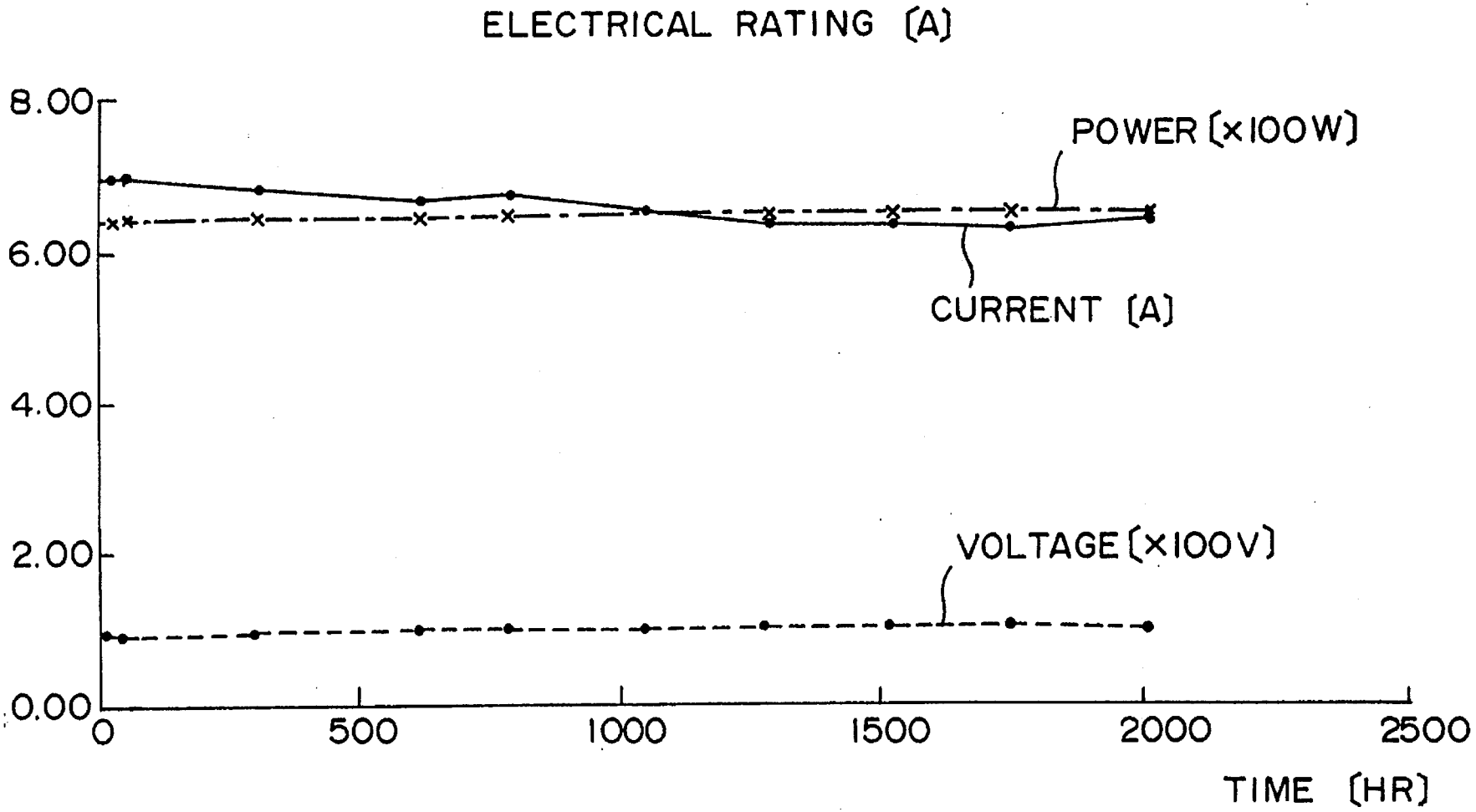
FIG. 6 is a graph showing an electrical rating of a metal halide lamp of the present invention.
Figure 7:
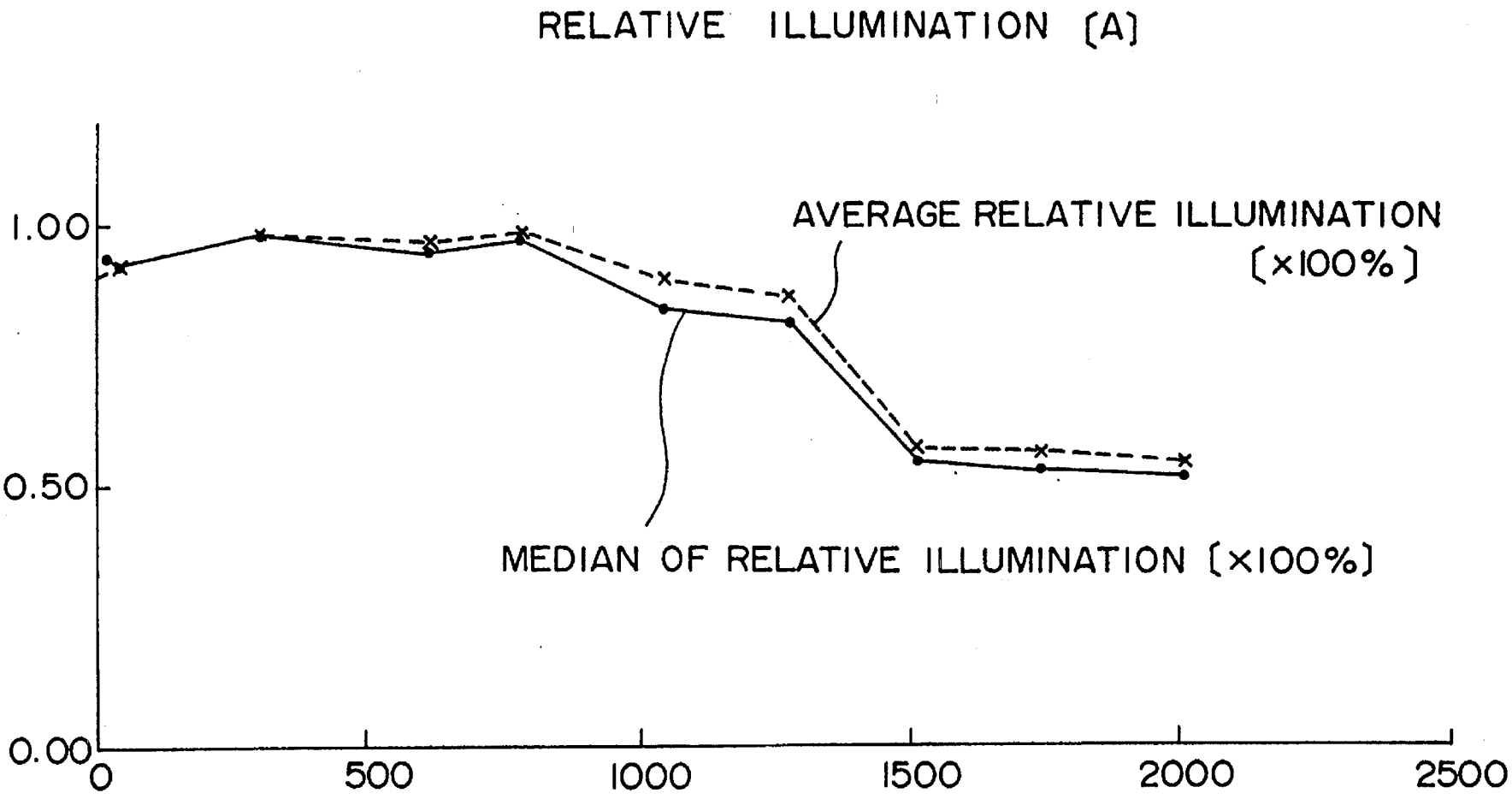
FIG. 7 is a graph showing a relative illumination of a metal halide lamp of the present invention.
Figure 8:
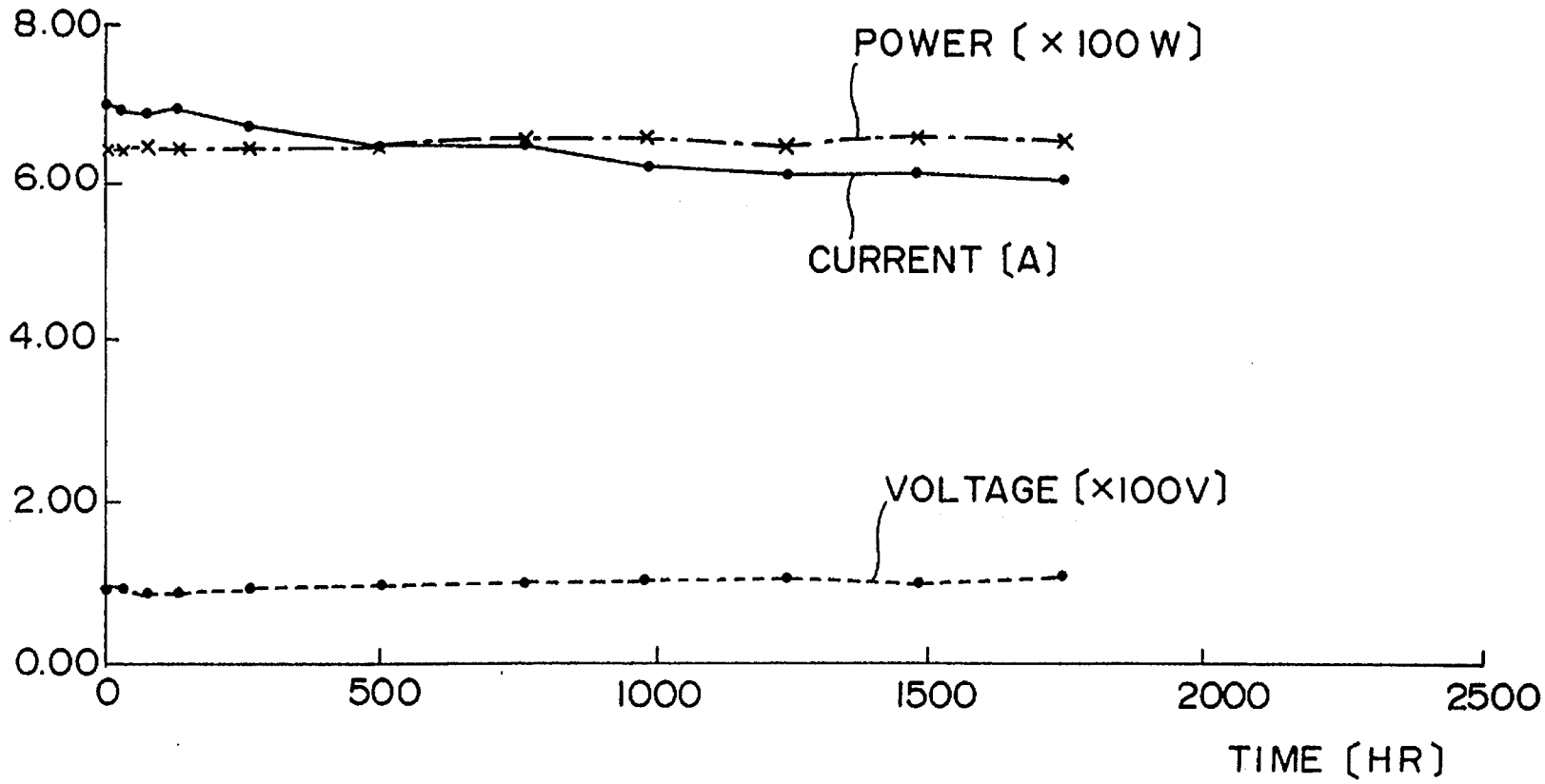
FIG. 8 is a graph showing an electrical rating of another metal halide lamp of the present invention.
Figure 9:
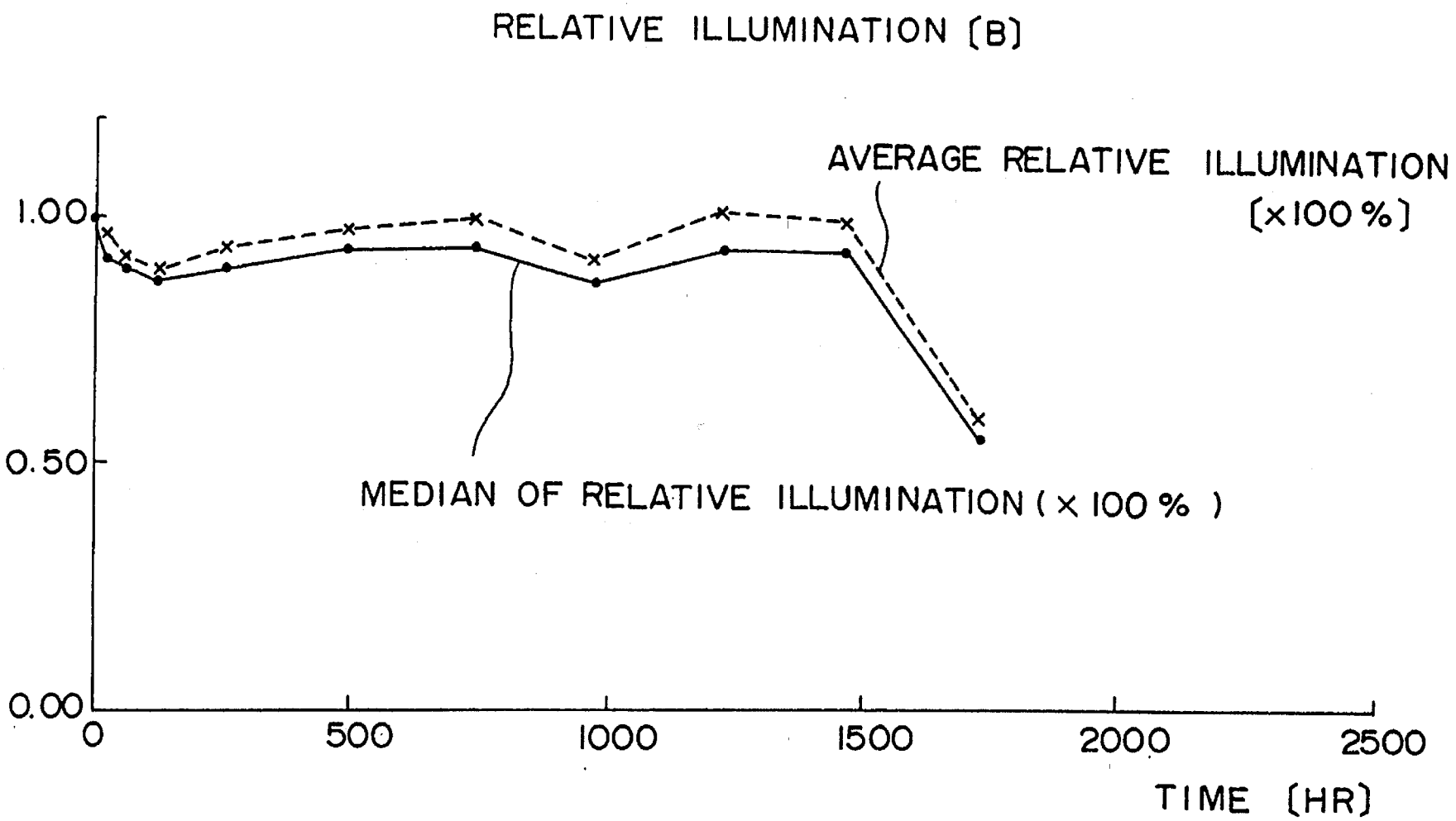
FIG. 9 is a graph showing a relative illumination of another metal halide lamp of the present invention.
Figure 10:
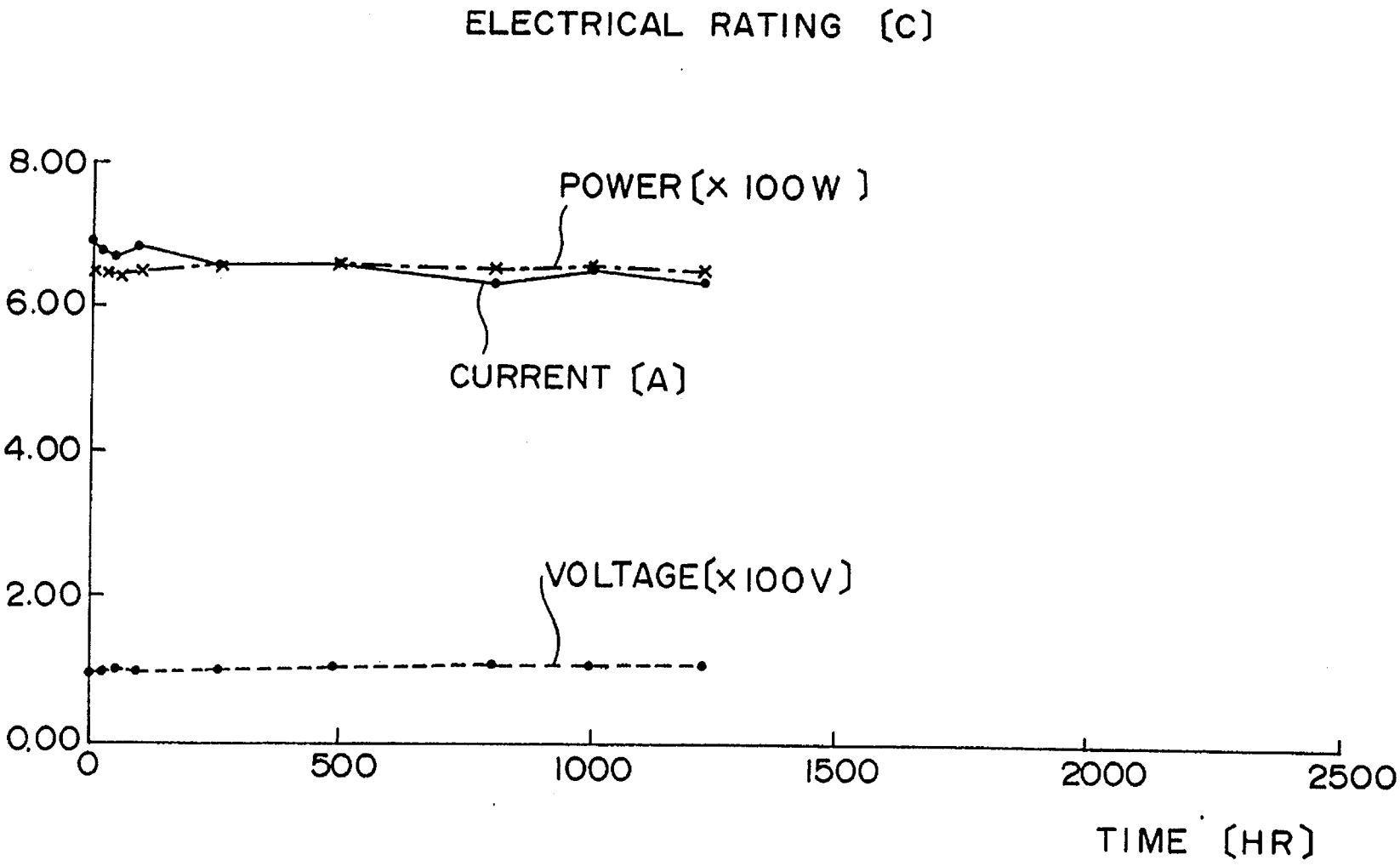
FIG. 10 is a graph showing an electrical rating of a conventional metal halide lamp.
Figure 11:
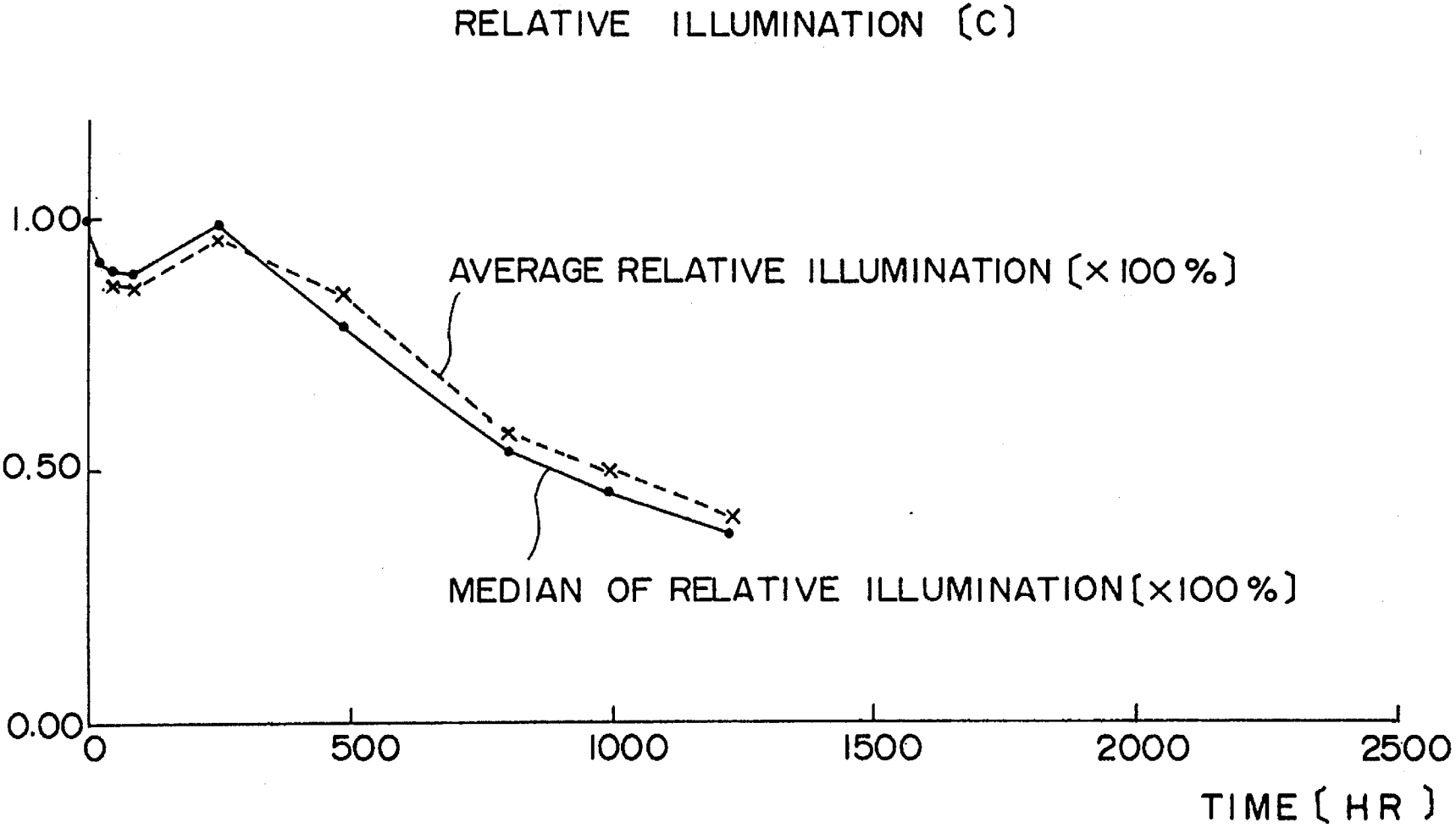
FIG. 11 is a graph showing a relative illumination of a conventional metal halide lamp.

FIGS. 6 to 11 show electrical rating and relative illuminance obtained in experiment using the metal halide lamps A, B and C. Here, FIG. 6 and FIG. 7 show experiment results of the metal halide lamp A; FIG. 8 and FIG. 9, the metal halide lamp B; and FIG. 10 and FIG. 11, the metal halide lamp C.

It can be understood from these graphs that the metal halide lamps A and B have a much longer life time than the conventional metal halide lamp C. Especially, even the metal halide lamp A, which has a smaller amount of $HgI_2$ than the metal halide lamp C in which the conventional electrode is used, has a longer life time.

Next, the inventors analyzed deposits to a surface of the inner wall of the luminous portion 14 corresponding to the metal halide lamps A, B and C which were used up.

Figure 12:
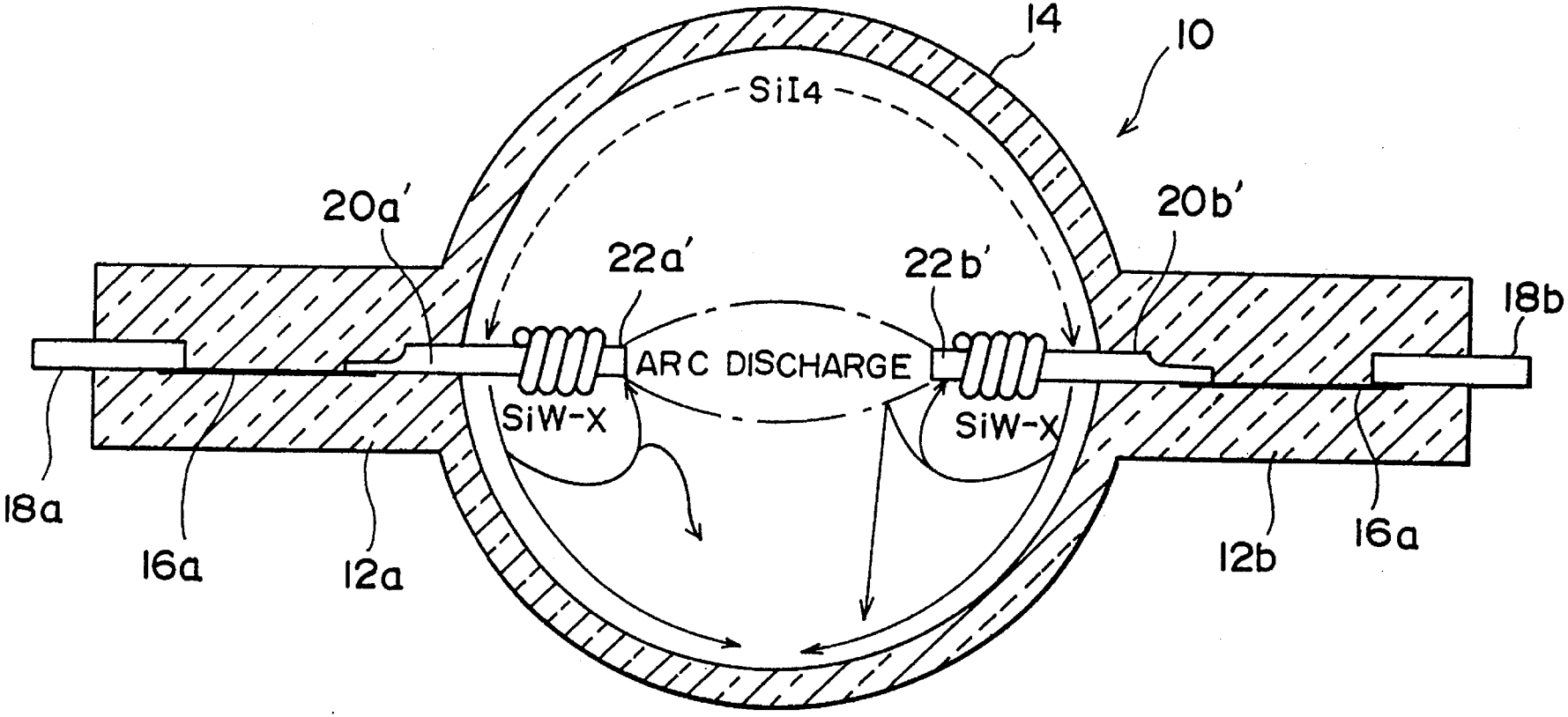
FIG. 12 is a view showing the principle of reaction in a conventional metal halide lamp.

In result, the inventors assumed that the following change in state took place in every metal halide lamp. As shown in FIG. 12, in the conventional metal halide lamp C, tungsten (W) of electrode reacts with halide of silicon ($SiI_4$), which is a component element of a bulb, at the proximal portion of the electrode, i.e., a portion near the sealed portion, and then low-melting alloy (SiW-X (where X is halogen; bromine or iodine)) is formed. The low-melting alloy tends to move towards the inner ends 22*a'* and 22*b'* of the electrodes 20*a'* and 20*b'* the temperature of which are high, but a part of the low-melting alloy is repelled to the surface of the inner wall of the bulb 10 by heat convection caused by arc discharge. Since the temperature of the inner wall surface of the bulb 10 is low, the repelled low melting point metal deposits on the inner wall, and as time elapses, the depositing amount increases. Then, the inner wall surface of the luminous portion 14 is whitened, and silica glass composing the bulb 10 reacts with the low-melting point alloy and is crystallized.

Figure 13:
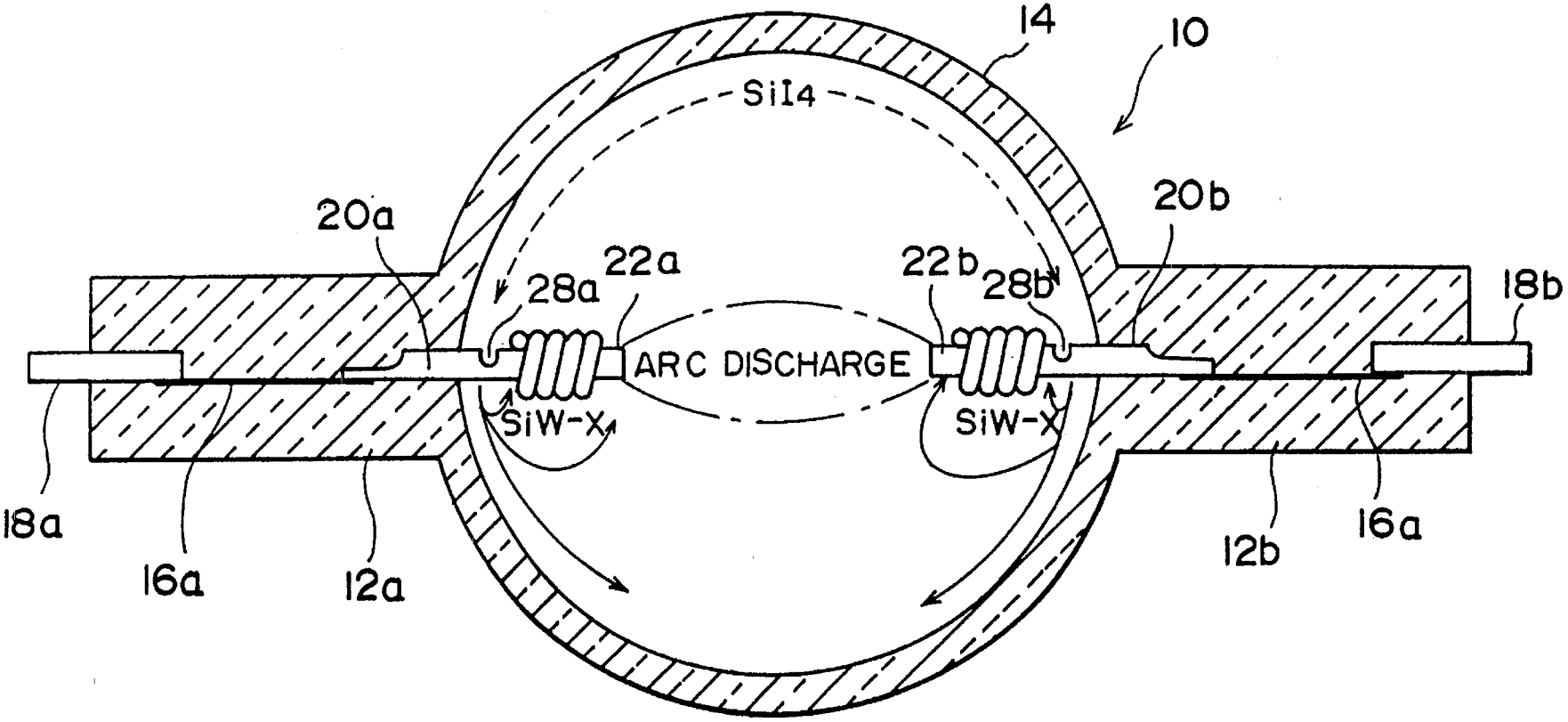
FIG. 13 is a view showing the principle of reaction in a metal halide lamp of the present invention.

On the other hand, as shown in FIG. 13, in the metal halide lamps A and B according to the present invention, temperature of regions from the notches 28*a* and 28*b* formed in the electrodes 20*a* and 20*b* to the inner ends 22*a* and 22*b* is higher than temperature of the same regions of the conventional electrodes 20' because of heat dam effect (effect of damming heat) of the notches 28*a* and 28*b*. On the contrary, since temperature of the proximal portions of the electrodes 20*a* and 20*b* on the sealed portions 12*a* and 12*b* sides of the notches 28*a* and 28*b* is lower than the temperature of the same portions of the conventional electrodes 20', formation of low-melting alloy (SiW-X) in these portions is suppressed. In addition, low-melting alloy formed in the proximal portions of the electrodes 20*a* and 20*b* tends to be trapped in the regions from the notches 28*a* and 28*b* to the inner ends 22*a* and 22*b* of the electrodes 20*a* and 20*b*, the temperature of which are high. Therefore, low-melting alloy moving to the arc discharge significantly is decreased as compared with the conventional metal halide lamp C. In result, the amount of low-melting alloy repelled to the inner wall of the bulb 10 due to arc discharge is also decreased, so that whitening of luminous portion 14 and crystallization of silica glass is also decreased.

The inventors analyzed silica glass of the luminous portion 14 before crystallization and silica glass of the luminous portion 14 after crystallization, using a scanning electron microscope. In result, a large amount of oxygen, carbon, silicon and a small amount of iron were detected from silica glass before crystallization. On the contrary, a large amount of oxygen, carbon and silicon were detected from silica glass after crystallization, which was same as the silica glass before crystallization, but instead of iron, a small amount of cesium and tungsten were detected. Accordingly, it was found that components of silica glass after crystallization were different from that of silica glass before crystallization.

As described above, as only the notch 28 is provided in the electrode 20, whitening of silica glass composing the luminous portion 14 of the bulb 10 and crystallization are decreased, and life time of metal halide lamps can be made longer. Damage of the bulb 10 due to crystallization of silica glass can be avoided. Further, forming the notch 28 in the electrode 20 is very easy, so that there are no problems of worsening of manufacture efficiency and increase of manufacture cost.

It was known from various experiments that depth of the notch 28 and life time (time until silica glass is crystallized) of metal halide lamp were substantially proportional to each other.

Next, the other embodiments according to the present invention will be explained.

In the present invention, a cross sectional area of a portion of electrode is made smaller than cross sectional areas adjacent to the portion of electrode so that the temperature of the inner end of the electrode is high, whereas the temperature of the proximal portion of the electrode is low. In other words, because only a portion having a small cross sectional area needs to be provided in an electrode, the above-described notch is not only the example but various modification can be considered.

Figure 14:
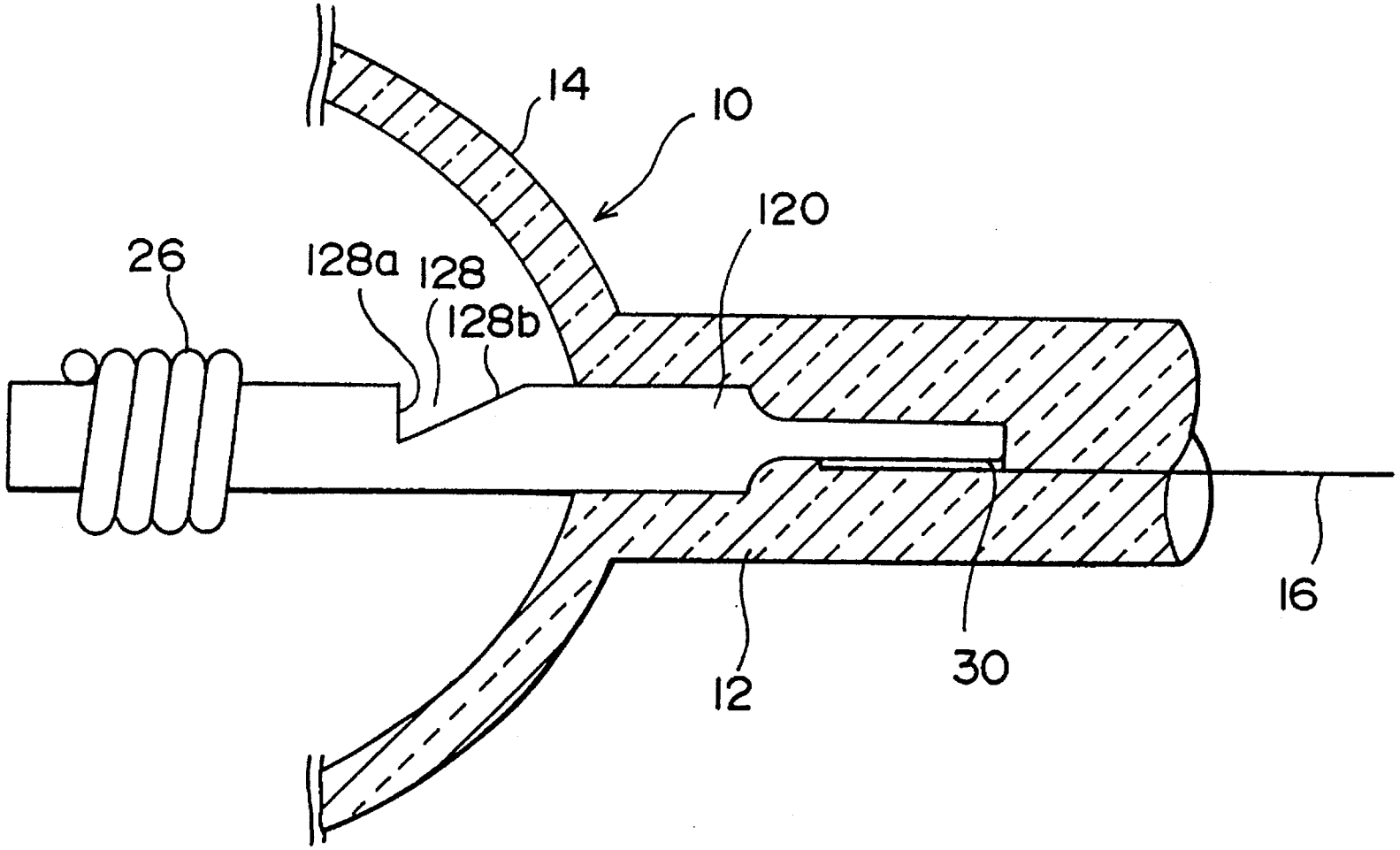
FIG. 14 is a partial sectional view showing a metal halide lamp according to the second embodiment of the present invention.
Figure 15:
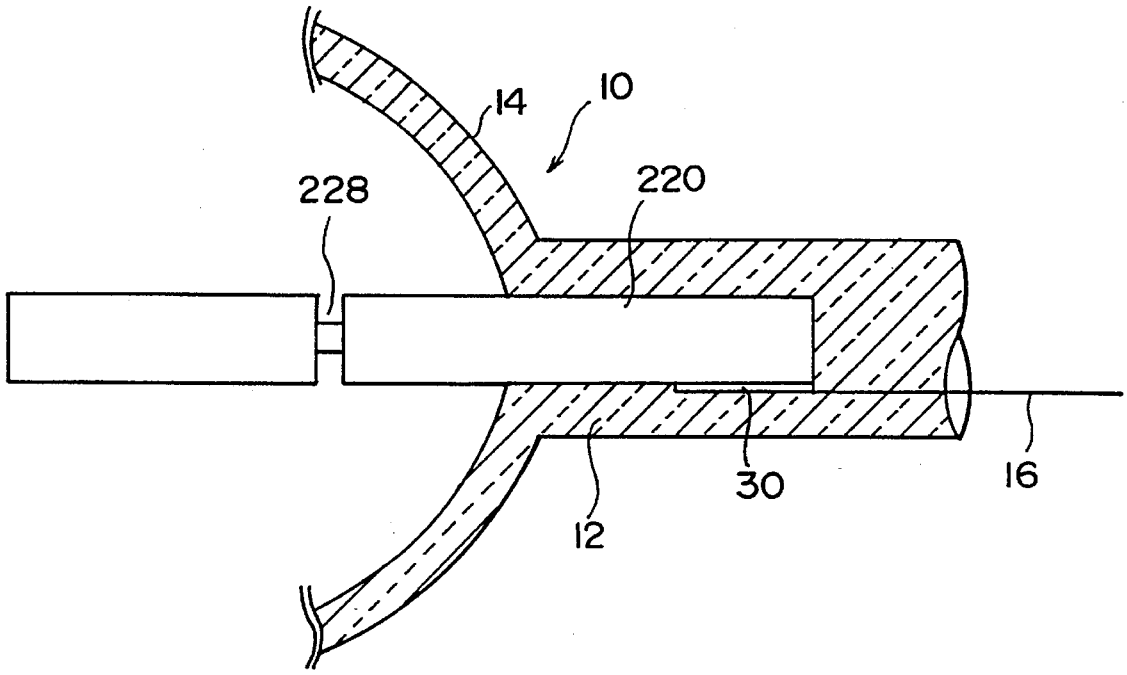
FIG. 15 is a partial sectional view showing a metal halide lamp according to the third embodiment of the present invention.

FIG. 14 shows an electrode 120 according to the second embodiment of the present invention. The electrode 120 has a notch 128 defined by a face 128*a* perpendicular to the axis of the electrode 120 and a face 128*b* leaning against the axis. FIG. 15 shows an electrode 220 according to the third embodiment of the present invention. In this third embodiment, a notch 228 is circumferentially formed in an electrode 220. In an electrode 320 of the fourth embodiment shown in FIG. 16, two notches 328 and 329 are formed apart by a certain distance along an axis direction of an electrode 320. In these embodiments, a shape of notch and the number of notches are different from the first embodiment but it is apparent to those skilled in the art that their functions and effects are substantially the same as the first embodiment.

It will be noted that shapes of portions of the electrodes 120, 220 and 320 of the second, third and fourth embodiments, to which a molybdenum foil 16 is connected with a platinum 30, are different from those of the same portions of the first embodiment, but the difference of the shapes will not alter the function and effects. Without a molybdenum foil and an external lead pin, an electrode can be made to penetrate a sealed portion, which is not shown in drawings.

Figure 16:
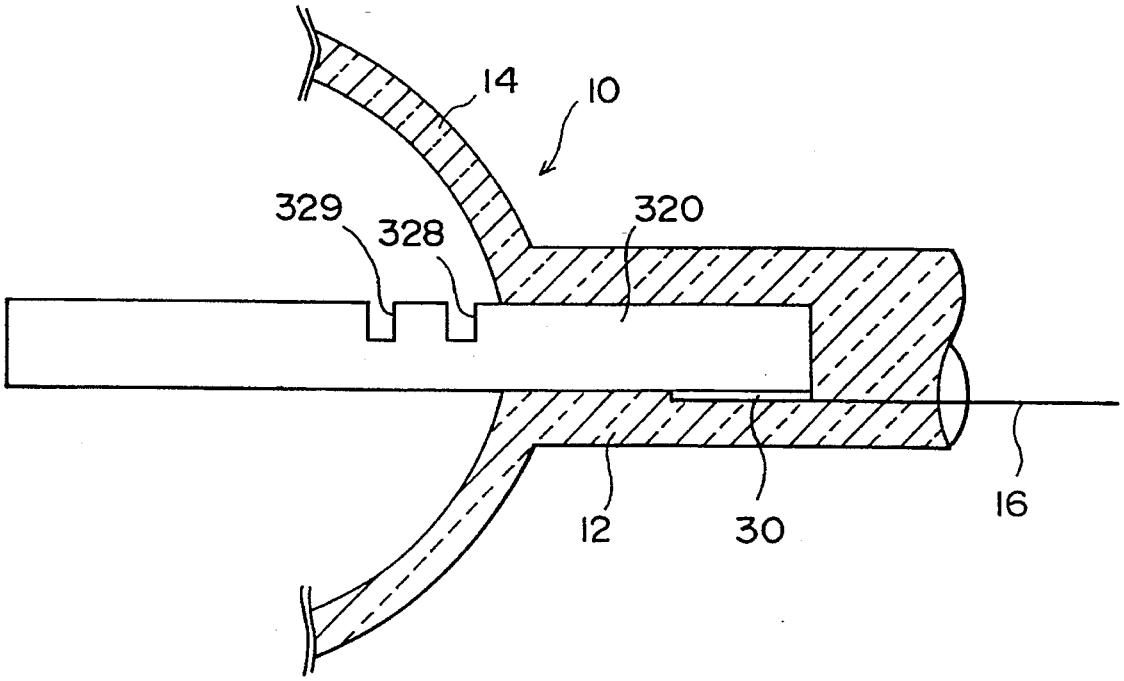
FIG. 16 is a partial sectional view showing a metal halide lamp according to the fourth embodiment of the present invention.

Further, in the first and second embodiments, a tungsten coil 26 is wound on to the electrodes 20 and 120 in order to improve the heat storage effect; however, as shown in FIG. 15 and FIG. 16, even electrodes without tungsten coils has the above-described effects.

Figure 17:
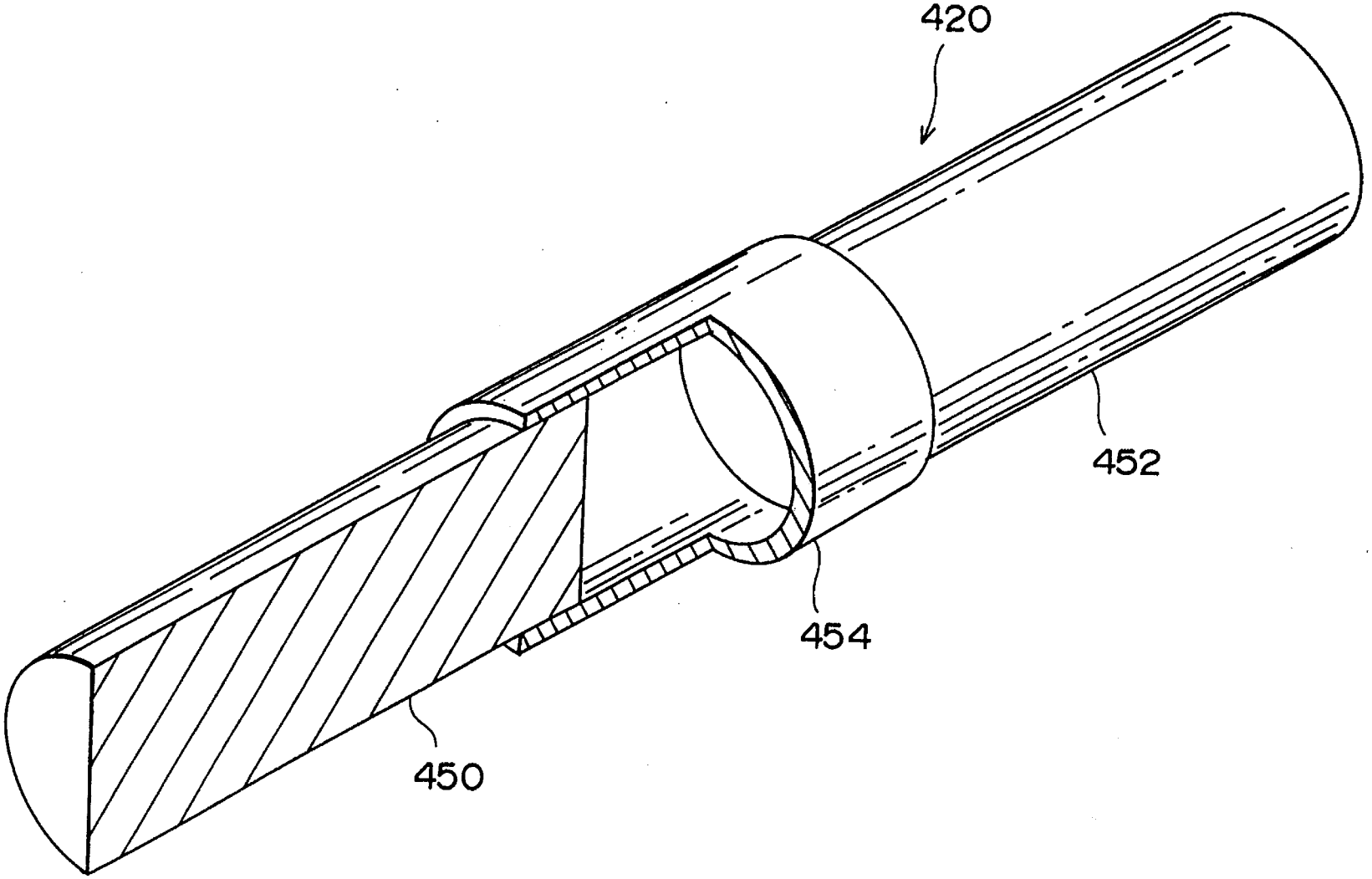
FIG. 17 is a perspective view showing an electrode used in a metal halide lamp according to the fifth embodiment of the present invention.

Furthermore, the electrode 420 of the fifth embodiment as shown in FIG. 17 is formed such that a cylindrical tungsten rod 450 is connected with a tungsten rod 452 having the same shape as the tungsten rod 450 with a cylindrical pipe 454 made of tungsten. The tungsten rod 452 is supported by the sealed portion 12 of the bulb 10, and the pipe 454 and the other tungsten rod 450 are exposed inside the luminous portion 14. It is preferable that the ends of the tungsten rods 450 and 452 are coupled with the pipe 454 by close fit. A certain space is formed between the opposing ends of the tungsten rods 450 and 452. Consequently, if two tungsten rods 450 and 452 are connected with the pipe 454 which has a smaller cross sectional area than that of the two tungsten rods 450 and 452 and a small space is formed between the tungsten rods 450 and 452, the pipe 454 presents the same heat dam effect as the notch 28 of electrode of the first embodiment. Then, the temperature of the tungsten rod 450 far from the sealed portion 12 becomes high and the temperature of the tungsten rod 452 near the sealed portion 12 becomes low. Accordingly, with this electrode 420, whitening of the luminous portion 14 of the bulb 10 and crystallization of silica glass can be prevented.

Figure 18:
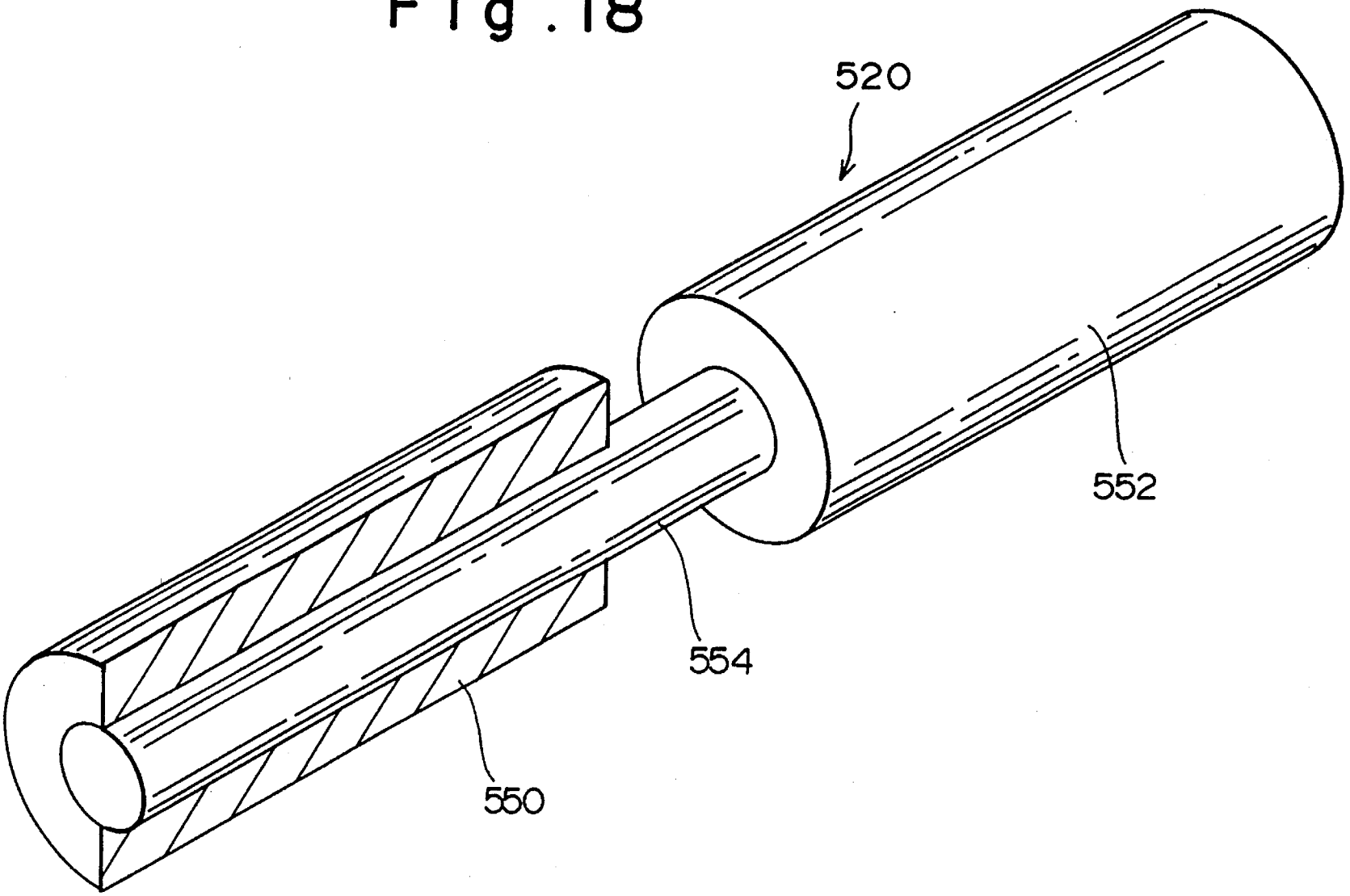
FIG. 18 is a perspective view showing an electrode used in a metal halide lamp according to the sixth embodiment of the present invention.

An electrode 520 of the sixth embodiment as shown in FIG. 18 is formed such that a tungsten rod 554 are tightly inserted into thick cylindrical tungsten tubes 550 and 552. The tungsten rod 554 has the same radius as the hollows of the tungsten tubes 550 and 552. A small space is formed between the faced ends of the tungsten tubes 550 and 552. Thus formed electrode 520 has the same configuration as the electrode 320 shown in FIG. 15. Consequently, the electrode 520 has the same function and effects as the embodiment of FIG. 15.

The cross sections of the electrodes of the above-described embodiments are circular but the shape of cross section is not limited to this. For example, it can be square, rectangular, triangle, polygon, or undefined-shaped. This is because the function and effects of the present invention do not depend on the shape of cross section but relates to a cross sectional area of a notch or heat dam portion and cross sectional areas of portions in front and in the rear of the notch.

Figure 19:
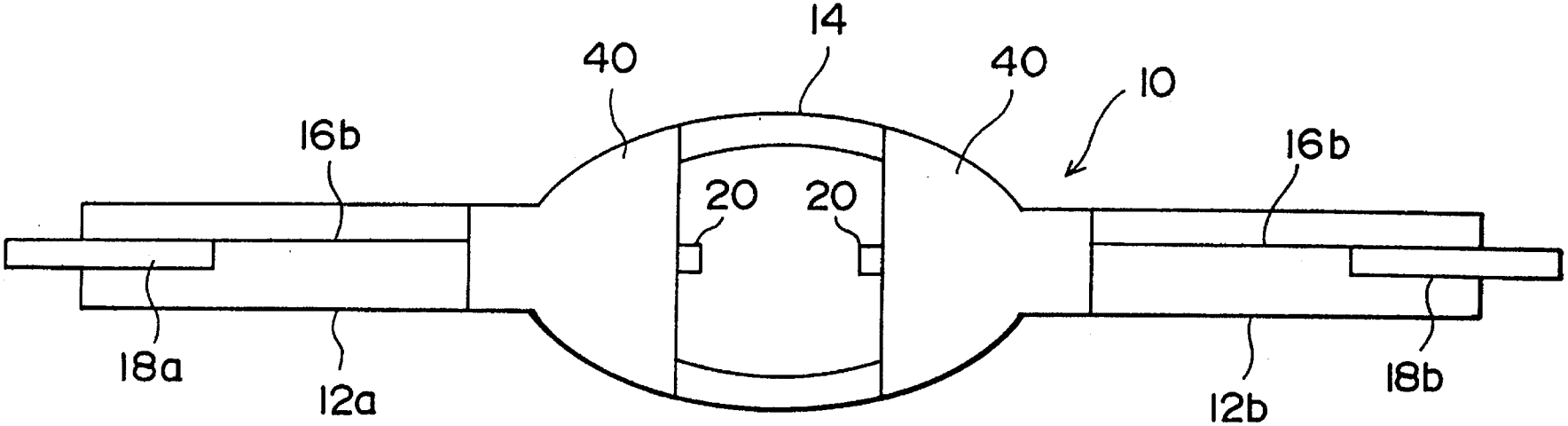
FIG. 19 is a sectional view showing a heat reserving film on a metal halide lamp using an electrode of the first embodiment.

In the metal halide lamp in which the electrode of each embodiment is used, as shown in FIG. 19, a heat reserving film 40 is preferably provided on the external surface of the luminous portion 14. The heat reserving film 40 is a ceramic thin film comprising $ZrO_2$ as a major material, alumina and inorganic oxide titanium, and prevents temperature of wall of luminous portion 14 from decreasing and prevents internal temperature of the luminous portion 14 from decreasing due to the external atmosphere.

In a case that transparent alumina is used as a material of bulb instead of silica glass, electrodes utilized in the present invention can obtain the same effects as the electrode of silica glass. Further, a shape of bulb is not limited to the ones shown in the above embodiments but for example, a shape of the luminous portion can be rectangular prism or another shape, and a shape of the sealed portion can be rectangular prism or another shape.

There are a direct current metal halide lamp and an alternative current metal halide lamp. While in the direct current metal halide lamp, one of electrode is anode and the other is cathode, in the alternative current metal halide lamp, the electrodes have no such difference. Accordingly, with regard to the alternative current metal halide lamp, it is preferable that a heat dam portion such as a notch is provided in both electrodes in the same way as the above-described embodiments. On the other hand, with regard to the direct current metal halide lamp, a heat dam portion having a very small cross sectional area as compared with the portions in front and in the rear of the heat dam portion is provided in only one of electrodes, and the conventional electrode can be used for the other electrode. This is because in the direct current metal halide lamp, temperature of anode significantly increases as compared with the other. Accordingly, in the direct current metal halide lamp, an electrode in which a heat dam portion is provided is an anode electrode. Thus, in the direct current metal halide lamp, even though the heat dam portion is provided in only one of electrodes, effects of preventing a luminous portion from being whitened and preventing silica glass from being crystallized can sufficiently be achieved.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

The basic Japanese Application No. 5-260,941 filed on Oct. 19, 1993 is hereby incorporated by reference.

What is claimed is:

1. A metal halide lamp comprising:

a sealed tube made of a light transmitting material, said sealed tube containing metal vapor and halide therein; and a pair of electrodes supported by support portions of said sealed tube, each of said electrodes having an end which extends to the inside of said sealed tube, said electrodes being arranged so that said ends are opposed and spaced to each other;

wherein at least one of said electrodes has a groove provided between said end and a portion supported by said support portion of said sealed tube.

2. A metal halide lamp according to claim 1, wherein said groove is provided in both said electrodes.

3. A metal halide lamp according to claim 1, wherein said groove is provided near said support portion.

4. A metal halide lamp according to claim 1, wherein said electrode is an elongate rod member.

5. A metal halide lamp according to claim 4, wherein said groove extends in a direction perpendicular to a longitudinal axis of said electrode.

6. A metal halide lamp according to claim 5, wherein said groove is formed in said electrode around entire circumference.

7. A metal halide lamp according to claim 4, wherein said electrode has a plurality of said grooves each of which extends in a direction perpendicular to a longitudinal axis of said electrode and which are disposed at a predetermined interval along the longitudinal axis of said electrode.

8. A metal halide lamp according to claim 1, wherein said electrode is made of a material comprising tungsten as a base material.

9. A metal halide lamp according to claim 1, wherein said sealed tube includes a pair of sealed portions provided at both ends, said sealed portions being formed by melting and solidifying said ends of said sealed tube, and a luminous portion provided between said sealed portions.

10. A metal halide lamp according to claim 9, wherein said electrodes are supported by said sealed portions.

11. A metal halide lamp according to claim 1, wherein said electrode has a heat reserving coil wound around a portion between said end and said groove.

12. A metal halide lamp according to claim 1, wherein said sealed tube is made of silica glass.

13. A metal halide lamp according to claim 1, wherein said sealed tube is made of alumina having a property of transmitting light.

14. A metal halide lamp comprising:

a sealed tube made of a light transmitting material, said sealed tube containing metal vapor and halide therein; and a pair of electrodes supported by support portions of said sealed tube, each of said electrodes having an end which extends to the inside of said sealed tube, said electrodes being arranged so that said ends are opposed and spaced to each other;

wherein each said electrode comprises two rod members made of an electrode material, one of said rod members being supported by said support portion of said sealed tube, and a pipe made of the electrode material, having a smaller transverse cross sectional area size than said rod members, one end of each said rod member being fitted into the respective end of said pipe thereby to connect said rod members.

15. A metal halide lamp according to claim 14, wherein said electrode material comprises tungsten as a base material.

16. A metal halide lamp according to claim 14, wherein said sealed tube is made of silica glass.

17. A metal halide lamp according to claim 14, wherein said sealed tube is made of alumina having a property of transmitting light.

18. A metal halide lamp comprising:

a sealed tube made of a light transmitting material, said sealed tube containing metal vapor and halide therein; and a pair of electrodes supported by support portions of said sealed tube, each of said electrodes having an end which extends to the inside of said sealed tube, said electrodes being arranged so that said ends are opposed and spaced to each other;

wherein each said electrode comprises one elongate rod member made of an electrode material, and a pair of pipes made of the electrode material, into which the ends of said rod member are respectively fitted so as to be spaced to each other, one of said pipes being supported by said support portion of said sealed tube.

19. A metal halide lamp according to claim 18, wherein said electrode material comprises tungsten as a base material.

20. A metal halide lamp according to claim 18, wherein said sealed tube is made of silica glass.

21. A metal halide lamp according to claim 18, wherein said sealed tube is made of alumina having a property of transmitting light.

22. An electrode utilized in an electrical discharge lamp, said electrode having a groove provided between a portion to be supported by a support portion of a sealed tube of the electrical discharge lamp, and an end to be placed inside a luminous portion of said sealed tube.

23. An electrode according to claim 22, wherein said electrode is elongate rod member.

24. An electrode according to claim 22, wherein said electrode is made of an electrode material comprising tungsten as a base material.

25. An electrode according to claim 22, wherein said groove extends in a direction perpendicular to a longitudinal axis of said electrode.

26. An electrode according to claim 22, wherein said groove is circumferentially formed in said electrode.

27. An electrode according to claim 22, wherein said electrode has a plurality of said grooves each of which extends in a direction perpendicular to a longitudinal axis of said electrode and which are disposed at a predetermined interval along the longitudinal axis of said electrode.

28. An electrode utilized in an electrical discharge lamp, comprising two rod member made of an electrode material, and a pipe made of the electrode material, having a smaller transverse cross sectional area size than said rod members, one end of each said rod member being fitted into the respective end of said pipe thereby to connect said rod members.

29. A metal halide lamp according to claim 28, wherein said electrode material comprised tungsten as a base material.

30. An electrode utilized in an electrical discharge lamp, comprising one elongating rod member made of an electrode material, and a pair of pipes made of the electrode material, into which the ends of said rod member are respectively fitted so as to be spaced from each other.

31. A metal halide lamp according to claim 30, wherein said electrode material comprises tungsten as a base material.

* * * * *